US005145505A

United States Patent [19]

Saito et al.

[11] Patent Number: 5,145,505

[45] Date of Patent: Sep. 8, 1992

[54] HIGH TOUGHNESS CERMET AND PROCESS FOR PREPARING THE SAME

[75] Inventors: Takeshi Saito; Kozo Kitamura; Mitsuo Ueki, all of Kawasaki, Japan

[73] Assignee: Toshiba Tungaloy Co., Ltd., Kawasaki, Japan

[21] Appl. No.: 832,316

[22] Filed: Feb. 7, 1992

[30] Foreign Application Priority Data

Feb. 13, 1991 [JP] Japan ..... 3-41268

[51] Int. Cl.[5] ..... C22C 29/04

[52] U.S. Cl. ..... 75/238; 75/230; 75/236; 75/237; 75/240; 75/244; 419/10; 419/13; 419/14; 419/15; 419/16; 419/17; 419/18; 419/25; 419/38; 419/47; 419/57

[58] Field of Search ..... 75/230, 236, 237, 238, 75/240, 244; 419/10, 13-18, 25, 47, 57, 38

[56] References Cited

U.S. PATENT DOCUMENTS 4,830,930 5/1989 Taniguchi et al. ..... 75/244

4,963,321 10/1990 Saitoh et al. ..... 419/13

*Primary Examiner*—Stephen J. Lechert, Jr.

*Attorney, Agent, or Firm*—Foley & Lardner

[57] ABSTRACT

Disclosed are a high toughness cermet comprising a sintered alloy comprising 75 to 95% by weight of a hard phase of carbide, nitride or carbonitride containing Ti, at least one of W, Mo and Cr, and N and C, and the balance of a binder phase composed mainly of an iron group metal, and inevitable impurities, wherein the content of Ti in said sintered alloy is 35 to 85% by weight calculated on TiN or TiN and TiC, and the contents of W, Mo and Cr are 10 to 40% by weight in total calculated on WC, $Mo_2C$ and/or $Cr_3C_2$, the relative concentration of said binder phase at the 0.01 mm-inner portion from the surface of said sintered alloy is 5 to 50% of the average binder phase concentration of the inner portion, and the relative concentration of said binder phase at the 0.1 mm-inner portion from the surface of said sintered alloy is 70 to 100% of the average binder phase concentration of the inner portion, and a compression stress of 30 kgf/mm$^2$ or more remains at the surface of said sintered alloy, and a process for preparing the same.

6 Claims, No Drawings

HIGH TOUGHNESS CERMET AND PROCESS FOR PREPARING THE SAME

BACKGROUND OF THE INVENTION

This invention relates to a high toughness (tenacious) cermet suitable as a material for cutting tools such as lathe cutting tools, slicing tools, drills and end mills, or a material for abrasion resistant and corrosion resistant tools such as slitters, cutting blades, dies for can making and nozzles, most suitable as a material for cutting tools, particularly as a material for wet cutting tools which require thermal shock resistance, and a process for preparing the same.

In the prior art, TiC-based cermets can be roughly classified into N (nitrogen)-non-containing TiC-based cermets and N-containing TiC-based cermets. Of these, N-containing TiC-based cermets tend to be more excellent in strength and plastic deformation resistance as compared with N-non-containing TiC-based cermets, For this reason, TiC-based cermets in recent days tend to be mainly N-containing TiC-based cermets.

However, N-containing TiC-based cermets have a problem that the surface portion of a sintered alloy is liable to be brittle (or fragile) as compared with the inner portion due to denitrification and carburization in a sintering step.

To cope with such a problem, a proposal of providing a surface portion preferred from the points of characteristics of a sintered alloy has been made, which is represented by Japanese Unexamined Patent Publications No. 31949/1989 and No. 15139/1990.

Japanese Unexamined Patent Publication No. 31949/1989 discloses a high toughness cermet obtained by imparting a compressive stress of 50 kg/mm$^2$ or more to a hard phase at the surface portion of a burnt surface of a sintered alloy comprising a hard phase comprising at least one of carbide, nitride, carbonitride, oxynitride and boride of the 4a, 5a or 6a group metals of the periodic table and solid solutions of these, a binder phase composed mainly of Ni and/or Co, and inevitable impurities.

The high toughness sintered alloy disclosed in the above patent publication is an alloy improved in flexural strength and fracture resistance by imparting compressive stress thereto by applying impact force to the surface portion of the burnt surface by means of shot peening or sand blast. However, there involve problems that abrasion resistance and thermal shock resistance have not been taken into consideration, and particularly when it is used as a material for wet cutting tools, abrasion resistance is poor and also reliability of preventing sudden fracture caused by occurrence and progress of thermal cracking is poor.

Japanese Unexamined Patent Publication No. 15139/1990 discloses an N-containing TiC-based cermet having a maximum surface roughness of a burnt surface of 3.5 μm or less, substantially free from pore and void, and having a hard and high toughness region provided at a surface portion. The cermet disclosed in the above patent publication is a cermet improved in abrasion resistance and fracture resistance by imparting high toughness and high hardness thereto by using a sintered alloy having high surface precision of a surface to be heated and substantially free from pore and void. However, there involve problems that fracture resistance is not satisfactory, thermal shock resistance is poor, and particularly when it is used as a material for wet cutting tools, reliability of preventing sudden fracture caused by occurrence and progress of thermal cracking is poor.

SUMMARY OF THE INVENTION

The present invention has solved the problems as described above, and specifically, an object of the present invention is to provide a high toughness cermet in which a relative concentration of a binder phase at a surface portion is made smaller than an average binder phase concentration of an inner portion, compressive stress is allowed to remain at a surface to increase thermal shock resistance, and abrasion resistance and fracture resistance with good balance, and a process for preparing the same.

The present inventors have investigated about improvement in various characteristics of an N-containing TiC-based cermet, particularly improvement in characteristics in the case where it is used as a material for wet cutting tools. As a result, the following findings have been obtained.

Firstly, when a region extremely reduced in binder phase as compared with an inner portion is provided at the surface portion of a sintered alloy, the region becomes hard to improve abrasion resistance.

Secondly, since the above region is hard and also fragile, there is caused a problem that mechanical shock resistance is lowered. However, when the concentration of the binder phase is changed greatly and the depth of the above region is made smaller, lowering in mechanical shock resistance can be inhibited.

Thirdly, when the binder phase concentration at the above region is changed greatly, compressive stress is generated at the surface portion due to difference in heat shrinkage during a cooling step after sintering, whereby resistance to spread of thermal cracking, namely, resistance to thermal shock is improved extremely.

The present invention has been accomplished based on the first, second and third findings.

That is, the high toughness cermet of the present invention comprises a sintered alloy comprising 75 to 95% by weight of a hard phase of carbide, nitride or carbonitride containing Ti (titanium), at least one of W (tungsten), Mo (molybdenum) and Cr (chromium), and N (nitrogen) and C (carbon), and the balance of a binder phase composed mainly of an iron group metal, and inevitable impurities, wherein the content of Ti in said sintered alloy is 35 to 85% by weight calculated on TiN or TiN and TiC, and the contents of W, Mo and Cr are 10 to 40% by weight in total calculated on WC, $Mo_2C$ and/or $Cr_3C_2$, the relative concentration of said binder phase at the 0.01 mm-inner portion from the surface of said sintered alloy is 5 to 50% of the average binder phase concentration of the inner portion, and the relative concentration of said binder phase at 0.1 mm-inner portion from the surface of said sintered alloy is 70 to 100% of the average binder phase concentration of the inner portion, and a compression stress of 30 kgf/mm$^2$ or more remains at the surface of said sintered alloy.

DESCRIPTION OF THE PREFERRED EMBODIMENTS

In the following, the present invention is explained in detail.

As the hard phase of the present invention, there may be mentioned specifically, for example, TiC, TiN, Ti(C,N), WC, $Mo_2C$, $Cr_3C_2$, (Ti,M')C and (Ti,M')(C,N) (where M' represents at least one of W, Mo and Cr). In addition to these hard phases, there may be mentioned hard phases comprising carbide, nitride or carbonitride containing the 5a group metal (Ta, Nb and V) of the periodic table and/or the 4a group metal (Ti, Zr and Hf) (excluding Ti) of the periodic table, specifically, for example, TaC, NbC, VC, ZrC, HfC, TaN, NbN, VN, ZrN, HfN, Ta(C,N), Nb(C,N), V(C,N), Zr(C,N), Hf(C,N), (Ti,M")C, (Ti,M"N), (Ti,M")(C,N), (Ti,M',M")C, (Ti,M',M")(C,N), (M',M")C and (M',M")(C,N) (where M" represents at least one of Ta, Nb, V, Zr and Hf). The hard phase of the present invention comprises at least one described above, and may be a hard phase with a composite structure in which the core portion and the peripheral portion are different from each other, for example, the one in which the core portion comprises TiC or Ti(C,N) and the peripheral portion comprises (Ti,M')C, (Ti,M')(C,N), (Ti,M',M")C or (Ti,M',M")(C,N), which comprises a stoichiometric composition or a non-stoichiometric composition.

The binder phase constituting the cermet of the present invention in addition to the hard phase is specifically composed mainly of, for example, Fe, Ni and Co, and formed as a solid solution with other elements constituting the hard phase.

In the present invention, if the hard phase exceeds 95% by weight, the binder phase becomes less than 5% by weight relatively, to lower fracture resistance and thermal shock resistance significantly, while if the hard phase is less than 75% by weight, the binder phase exceeds 25% by weight relatively, to lower abrasion resistance and plastic deformation resistance significantly. For this reason, the hard phase is determined to be 75to 95% by weight based on the whole sintered alloy.

The content of Ti in the high toughness cermet of the present invention is calculated on the assumption that nitrogen contained in the sintered alloy is TiN. When Ti still remains after calculation on TiN, the content of Ti is calculated on the assumption that it becomes TiC. The amount thus calculated on TiN or TiN and TiC is 35 to 85% by weight based on the whole amount. If the calculated amount is less than 35% by weight, other components are increased too much to lower abrasion resistance, while if it exceeds 85% by weight, other components are decreased too much to lower fracture resistance.

In the present invention, the content of the 6a group metal (W, Mo and Cr) of the periodic table is obtained by calculating the whole content of W which is contained as a compound of W on WC, calculating the whole content of Mo which is contained as a compound of Mo on $Mo_2C$, and calculating the whole content of Cr which is contained as a compound of Cr on $Cr_3C_2$. The amount calculated on WC, $Mo_2C$ and/or $Cr_3C_2$ is 10 to 40% by weight bsed on the whole amount. If the calculated amount is less than 10% by weight, strengths of the hard phase and the binder phase become insufficient to lower fracture resistance, while if it exceeds 40% by weight, the content of Ti becomes small relatively, to lower abrasion resistance, and also the hard phase becomes rough to lower abrasion resistance.

The content of V, Nb or Ta in the present invention is calculated on TaC, NbC or VC, respectively, when contained as a compound of Ta, Nb or V. The calculated amount is 30% by weight or less based on the whole amount. If the calculated amount exceeds 30% by weight, the hard phase becomes rough to lower fracture resistance. For increasing strength at room temperature and high temperatures, at least one of V, Nb and Ta is preferably contained.

The content of Zr or Hf in the present invention is calculated on ZrC or HfC, respectively, when contained as a compound of Zr or Hf. The calculated amount is 5% by weight or less based on the whole amount. If the calculated amount exceeds 5% by weight, it becomes difficult to carry out sintering to generate micro pores and lower fracture resistance. For increasing abrasion resistance at the time of high speed cutting, the 4a group metal (Ti, Zr and Hf) excluding Ti of the periodic table is preferably contained.

The nitrogen contained in the sintered alloy of the present invention exists as a solid solution mainly in the hard phase, and has an effect of improving strength and improving thermal conductivity from room temperature to high temperatures. From the points of mechanical fracture resistance, thermal shock resistance and sintering property during preparation steps, the content of carbon and nitrogen is preferably 0.2 to 0.8 of carbon/(carbon+nitrogen) in terms of weight ratio.

In the present invention, the concentration distribution of the binder phase at the surface portion of the sintered alloy is specifically controlled by the relative concentrations of said binder phase at 0.01 mm-inner portion and at 0.1 mm-inner portion from the surface of the sintered alloy. By employing such a constitution, the binder phase concentrations of the binder phase at other surface portions are not so important. As for the relative concentration of the binder phase at the surface portion, if it is less than 5% of the average binder phase concentration of the inner portion at the 0.01 mm-inner portion from the surface of the sintered alloy, the binder phase becomes too hard to lower fracture resistance, while if it exceeds 50%, abrasion resistance is lowered, and it becomes difficult to make compressive stress remain at the surface portion during a sintering step. If the binder phase concentration at the 0.1 mm-inner portion is less than 70% of the average binder phase concentration of the inner portion, fracture resistance is lowered significantly.

If the compression stress at the surface of the sintered alloy of the present invention is less than 30 $kgf/mm^2$, the effect of increasing thermal shock resistance is weakened.

The high toughness cermet of the present invention can be also obtained by using a kind of bonding techniques, for example, by contact bonding of molded compacts having different binder phase amounts and then sintering. However, it is preferred to prepare the high toughness cermet of the present invention according to the following sintering steps from the standpoint of simplification of preparation steps.

That is, the process for preparing the high toughness cermet of the present invention is a process comprising the steps of mixing, molding, sintering and cooling of a starting material, wherein said sintering step is carried out under nitrogen gas atmosphere with a constant pressure of 5 to 30 Torr until completion of maintenance at from a liquid phase emergence temperature to a final sintering temperture, and said cooling step after completion of said maintenance at the final sintering temperature and until completion of solidifying the liquid phase is carried out under vacuum at a cooling rate of 10° to 20° C./min.

The characteristic feature of the sintering method of the present invention resides in that denitrification is inhibited to maintain the binder phase concentration distribution of the sintered alloy uniform by carrying out the sintering in nitrogen until completion of the maintenance at the final sintering temperature, and vacuum deaeration is carried out in the cooling step after completion of the maintenance to cause denitrification abruptly, whereby the concentration of the binder phase is inclined only in the vicinity of the surface.

In that case, the reason why the pressure of nitrogen gas is limited is that if the pressure of nitrogen gas is not more than 5 Torr, denitrification is not inhibited sufficiently at the final sintering temperature to enlarge a region where the binder phase concentration is reduced, whereby the predetermined inclination of the binder phase concentration at the surface portion cannot be obtained to lower fracture resistance. On the other hand, if it exceeds 30 Torr, the binder phase concentration at the surface portion becomes smaller than 5% to that of the inner portion, and also micro pores are generated to lower fracture resistance.

The reason why the pressure is maintained constantly is to prevent formation of a film comprising carbonitride on the surface of the sintered alloy or to maintain the binder phase concentration at the surface portion. If the pressure is increased gradually, a film comprising carbonitride is formed on the surface thereof, so that denitrification from the sintered alloy cannot occur by vacuum deaeration during the cooling step. On the other hand, if the pressure is decreased gradually, denitrification occurs during the sintering step to enlarge a region where the binder phase concentration is decreased.

The timing of introducing nitrogen is described. If nitrogen gas is introduced at a temperature lower than the liquid phase emergence temperature, sintering property is lowered and micro pores are generated to lower fracture resistance, while if nitrogen gas is introduced at a temperature higher than the liquid phase emergence temperature, a nitride film is formed on the surface of the sintered alloy undesirably. Therefore, nitrogen gas is introduced at the liquid phase emergence temperature.

The cooling step is also an important procedure. It is particularly preferred that the sintering atmosphere is vacuum during the cooling step until completion of solidifying the liquid phase (generally at about 1,250° C.). During the cooling step, denitrification occurs, and the predetermined inclination of the binder phase concentration is given. If the cooling rate in that step is less than 10° C./min, a region where the binder phase concentration is reduced is enlarged to lower fracture resistance, while if it is more than 20° C./min, the reducing amount of the binder phase concentration itself becomes small, whereby abrasion resistance is not improved and the driving force of generating residual stress becomes small undesirably.

The liquid phase emergence temperature herein mentioned corresponds to an eutectic temperature of a starting material(s) of the hard phase and a starting material(s) of the binder phase, or an eutectic temperature of a starting material(s) of the binder phase and non-metallic elements, and refers to a temperature at which a liquid phase is generated during elevating temperature, specifically, about 1,300° C. The completion of solidifying the liquid phase refers to a point when a liquid phase is changed to a solid phase during lowering temperature in the cooling step after completion of the sintering step, specifically, about 1,250° C. as described above.

The residual stress, namely compression stress at the surface of the sintered alloy can be measured by using X rays. However, since the binder phase has a crystal grain size of as large as several hundreds μm, precision of measurement is low. Therefore, the residual stress here is measured by stress with which a crystal grain of the hard phase is loaded.

The residual stress was measured by using the so-called Sin-$\phi$ method. That is, a (115) crystals face of a crystal grain having a B1 structure of the hard phase was measured symmetrically by using a target of Cu, an accelerating voltage of 40 kw and a current of 30 mA. As to the Young's modulus and Poisson's ratio of the crystal grain, values of TiC (45,000 kgf/mm$^2$ and 0.19) were used for convenience' sake.

The concentration distribution of the binder phase was measured by EPMA analysis. That is, by using samples grinded to have an angle of 7°, the respective ten points of the sites corresponding to the center of the sample, the 0.1 mm-inner portion from the surface and the 0.01 mm-inner portion from the surface were provided for surface analysis of a analysis area of 120×85 μm$^2$, and the concentration distribution was calculated from their average values.

The high toughness cermet of the present invention has action of increasing abrasion resistance of the surface portion where the binder phase is reduced. The surface portion causes lowering of fracture resistance. However, by controlling inclination of the binder phase concentration, the lowering of fracture resistance is inhibited to a minimum extent, and further, the compression stress which remains at the surface has action of increasing thermal shock resistance.

EXAMPLES

The present invention is described in detail by referring to Examples.

EXAMPLE 1

After commercially available starting materials having average grain sizes of 1 to 3 μm were formulated at weight ratios shown in Table 1, the formulated materials were mixed and pulverized by a wet ball mill (as to C/(C+N), analyzed values of the sintered alloys are shown, and other compositional components were not changed even after sintering, so that the compositional components of the sintered alloys are omitted).

Subsequently, the respective samples in Table 1 were dried, and molded into a TNMG160408 shape. These molded compacts were placed in a furnace, and the furnace was evacuated. After the furnace was heated to 1,300° C. at a temperature elevating rate of 5° C./min, nitrogen gas was introduced into the furnace, the furnace was heated to 1,500° C. under a nitrogen gas pressure of 15 Torr, and maintained for 60 minutes. Subsequently, as a cooling step, the furnace was evacuated and cooled to 1,250° C. at a cooling rate of 15° C./min. The furnace was left to cool to room temperature to prepare throw-away chips for cutting.

TABLE 1

| Sample No. | Formulating composition (% by weight) Amount of Ti TiN + TiC | Amount of Zr ZrC | Amount of Ta and Nb TaC | NbC | Amount of Mo and W $Mo_2C$ | WC | Iron group metal Ni | Co | Carbon, nitrogen in sintered alloy C/(C + N) (weight ratio) |
|---|---|---|---|---|---|---|---|---|---|
| Present sample 1 | 67 | — | — | — | 10 | 15 | 4 | 4 | 0.52 |
| Present sample 2 | 61 | — | — | — | 10 | 15 | 7 | 7 | 0.52 |
| Present sample 3 | 55 | — | — | — | 10 | 15 | 10 | 10 | 0.53 |
| Present sample 4 | 74 | — | — | — | 6 | 6 | 7 | 7 | 0.49 |
| Present sample 5 | 51 | — | — | — | 20 | 15 | 7 | 7 | 0.56 |
| Present sample 6 | 61 | — | — | — | 10 | 15 | 7 | 7 | 0.35 |
| Present sample 7 | 61 | — | — | — | 10 | 15 | 7 | 7 | 0.71 |
| Present sample 8 | 51 | — | 5 | 5 | 10 | 15 | 7 | 7 | 0.57 |
| Present sample 9 | 59 | 2 | — | — | 10 | 15 | 7 | 7 | 0.53 |
| Comparative sample 1 | 71 | — | — | — | 10 | 15 | 2 | 2 | 0.52 |
| Comparative sample 2 | 49 | — | — | — | 10 | 15 | 13 | 13 | 0.54 |
| Comparative sample 3 | 78 | — | — | — | 4 | 4 | 7 | 7 | 0.48 |
| Comparative sample 4 | 41 | — | — | — | 15 | 30 | 7 | 7 | 0.60 |
| Comparative sample 5 | 29 | — | 16 | 16 | 10 | 15 | 7 | 7 | 0.69 |
| Comparative sample 6 | 55 | 6 | — | — | 10 | 15 | 7 | 7 | 0.55 |

The binder phase concentration distributions at the surface portions of the sintered alloys thus obtained were measured by EPMA analysis, and the residual stress at the surfaces was measured by using an X ray stress device, respectively. The results are shown in Table 2.

TABLE 2

| Sample No. | Binder phase concentration distribution and residual stress at surface portion of sintered alloy: Binder phase concentration at surface portion relative to average binder phase concentration of inner portion of alloy (%) 0.01 mm-inner portion from surface | 0.1 mm-inner portion from surface | Residual compressive stress at surface of alloy (kgf/mm$^2$) |
|---|---|---|---|
| Present sample 1 | 22 | 83 | 42 |
| Present sample 2 | 21 | 83 | 59 |
| Present sample 3 | 18 | 81 | 70 |
| Present sample 4 | 34 | 87 | 41 |
| Present sample 5 | 10 | 80 | 73 |
| Present sample 6 | 19 | 77 | 61 |
| Present sample 7 | 24 | 89 | 54 |
| Present sample 8 | 18 | 82 | 63 |
| Present sample 9 | 20 | 83 | 60 |
| Comparative sample 1 | 24 | 84 | 31 |
| Comparative sample 2 | 16 | 81 | 92 |
| Comparative sample 3 | 40 | 89 | 36 |
| Comparative sample 4 | 7 | 79 | 77 |
| Comparative sample 5 | 16 | 81 | 65 |
| Comparative sample 6 | 19 | 83 | 61 |

TABLE 2-continued

Binder phase concentration distribution and residual stress at surface portion of sintered alloy For the present samples 1 to 9 and the comparative samples 1 to 6 shown in Table 2, abrasion resistance, fracture resistance and thermal shock resistance were tested. The abrasion resistance was evaluated by an average flank abrasion amount when wet continuous lathe cutting was carried out for 30 minutes by using a material to be cut of S48C, a cutting rate of 180 m/min, a cutting of 1.5 mm and a feed of 0.3 mm/rev. The fracture resistance was evaluated by carrying out wet intermittent lathe cutting of 1,000 revolutions of a material to be cut by using a material to be cut of S45C (having 4 slots), a cutting rate of 100 m/min, a cutting of 1.5 mm and an initial feed of 0.15 mm/rev, and if no fracture occurred by the above cutting, evaluation was made by a feed at the time of occurrence of fracture while increasing a feed by 0.05 mm/rev until fracture occurred. The thermal shock resistance was evaluated by a time until initial fracture occurred or fracture due to thermal cracking occurred when wet intermittent lathe cutting was carried out repeatedly by using a material to be cut of S45C, a cutting rate of 200 m/min, a cutting of 2.0 mm, a feed of 0.3 mm.rev, a cutting time of 60 seconds and an idle running and cooling time of 30 seconds. The respective results are shown in Table 3.

TABLE 3

| Sample No. | Average flank abrasion amount in abrasion resistance test (mm) | Feed at the time of occurrence of fracture in fracture resistance test (mm/rev) | Cutting time until fracture occurs in thermal shock resistance test (min) |
|---|---|---|---|
| Present sample 1 | 0.15 | 0.20 | 65 |
| Present sample 2 | 0.31 | 0.30 | 107 |
| Present sample 3 | 0.37 | 0.35 | 144 |
| Present sample 4 | 0.45 | 0.25 | 60 |
| Present sample 5 | 0.35 | 0.35 | 154 |

TABLE 3-continued

| Sample No. | Average flank abrasion amount in abrasion resistance test (mm) | Feed at the time of occurrence of fracture in fracture resistance test (mm/rev) | Cutting time until fracture occurs in thermal shock resistance test (min) |
|---|---|---|---|
| Present sample 6 | 0.32 | 0.25 | 130 |
| Present sample 7 | 0.31 | 0.35 | 80 |
| Present sample 8 | 0.32 | 0.35 | 122 |
| Present sample 9 | 0.27 | 0.25 | 112 |
| Comparative sample 1 | 0.13 | 0.15 | Initial fracture |
| Comparative sample 2 | Fracture in the middle of test (plastic deformation) | 0.35 | 3 |
| Comparative sample 3 | 0.35 | 0.20 | 56 |
| Comparative sample 4 | 0.46 | 0.25 | 55 |
| Comparative sample 5 | 0.35 | 0.15 | 103 |
| Comparative sample 6 | 0.45 | 0.15 | Initial fracture |

EXAMPLE 2

Samples having the formulated compositions shown in the present sample 2 in Table 1 of Example 1 were sintered under the sintering conditions as shown in Table 4. For the present samples 10 to 14 and the comparative samples 7 to 14 thus obtained, the binder phase concentration distributions at the surface portions and residual stress at the surfaces of the respective alloys were measured in the same manner as in Example 1. The results are shown in Table 5. By using the respective alloys, the same cutting test as in Example 1 was carried out. The results are shown in Table 6.

The alloys of the present samples 10 to 14 and the comparative samples 7 to 14 obtained had C/(C+N) ranging from 0.48 to 0.55, respectively.

TABLE 4

| | Sintering conditions | | | | | |
|---|---|---|---|---|---|---|
| | During introducing nitrogen gas | | During sintering | | During cooling | |
| Sample No. | Temperature (°C.) | Pressure (Torr) | Nitrogen pressure before sintering (Torr) | Nitrogen pressure during sintering (Torr) | Atmosphere (Torr) | Rate (°C./min) |
| Present sample 10 | 1300 | 15 | 15 | 15 | Vacuum | 15 |
| Present sample 11 | 1350 | 15 | 15 | 15 | Vacuum | 15 |
| Present sample 12 | 1300 | 10 | 10 | 10 | Vacuum | 15 |
| Present sample 13 | 1300 | 25 | 25 | 25 | Vacuum | 15 |
| Present sample 14 | 1300 | 15 | 15 | 15 | Vacuum | 15 |
| Comparative sample 7 | 1500 | 15 | 15 | 15 | Vacuum | 15 |
| Comparative sample 8 | 1300 | 3 | 3 | 3 | Vacuum | 15 |
| Comparative sample 9 | 1300 | 35 | 35 | 35 | Vacuum | 15 |
| Comparative sample 10 | 1300 | 15 | *15→20 | 20 | Vacuum | 15 |
| Comparative sample 11 | 1300 | 15 | 15 | **15→10 | Vacuum | 15 |
| Comparative sample 12 | 1300 | 15 | 15 | 15 | 15 ($N_2$) | 15 |
| Comparative sample 13 | 1300 | 15 | 15 | 15 | Vacuum | 5 |
| Comparative sample 14 | 1300 | 15 | 15 | 15 | Helium | 35 |

*25→20: Gradually increased from 15 Torr to 20 Torr
**15→10: Gradually decreased from 15 Torr to 10 Torr

TABLE 5

| | Binder phase concentration distribution and residual stress at surface portion of sintered alloy | | |
|---|---|---|---|
| | Binder phase concentration at surface portion relative to average binder phase concentration of inner portion of alloy (%) | | Residual compressive stress |
| Sample No. | 0.01 mm-inner portion from surface | 0.1 mm-inner portion from surface | at surface of alloy (kgf/mm²) |
| Present sample 10 | 21 | 83 | 59 |
| Present sample 11 | 18 | 80 | 69 |
| Present sample 12 | 33 | 86 | 43 |
| Present sample 13 | 9 | 80 | 75 |
| Present sample 14 | 21 | 83 | 77 |
| Comparative sample 7 | 60 | 95 | 8 |
| Comparative sample 8 | 57 | 94 | 14 |
| Comparative sample 9 | 2 | 76 | 85 |
| Comparative sample 10 | 63 | 95 | 13 |
| Comparative sample 11 | 15 | 65 | 65 |
| Comparative sample 12 | 73 | 98 | 10 |
| Comparative sample 13 | 15 | 63 | 67 |
| Comparative sample 14 | 70 | 89 | 11 |

TABLE 6

| Sample No. | Average flank abrasion amount in abrasion resistance test (mm) | Feed at the time of occurrence of fracture in fracture resistance test (mm/rev) | Cutting time until fracture occurs in thermal shock resistance test (min) |
|---|---|---|---|
| Present sample 10 | 0.31 | 0.30 | 107 |
| Present sample 11 | 0.28 | 0.30 | 141 |
| Present sample 12 | 0.42 | 0.35 | 65 |
| Present sample 13 | 0.21 | 0.25 | 160 |
| Present sample 14 | 0.31 | 0.30 | 165 |
| Comparative sample 7 | Fracture in the middle of test (plastic deformation) | 0.30 | 22 |
| Comparative sample 8 | Fracture in the middle of test (plastic deformation) | 0.30 | 28 |
| Comparative sample 9 | 0.15 | 0.15 | Initial fracture |
| Comparative sample 10 | Fracture in the middle of test (plastic deformation) | 0.20 | 27 |
| Comparative sample 11 | 0.26 | 0.15 | 130 |
| Comparative sample 12 | Fracture in the middle of test | 0.30 | 24 |
| Comparative sample 13 | 0.26 | 0.15 | 135 |
| Comparative sample 14 | Fracture in the middle of test (plastic deformation) | 0.30 | 24 |

As described above, the high toughness cermet of the present invention can provide an effect of increasing abrasion resistance by reducing a binder phase concentration at a surface portion, an effect of preventing lowering of fracture resistance by controlling the reduced region to be small, and an effect of increasing thermal shock resistance by allowing residual compression stress to exist at a surface. While conventional cermets and cermets outside the present invention are inferior in either point of abrasion resistance, fracture resistance or thermal shock resistance, the high toughness cermet of the present invention has excellent abrasion resistance, fracture resistance and thermal shock resistance with good balance.

Thus, the high toughness cermet of the present invention has an enlarged use region, and can be applied even to a wet intermittent cutting region to which conventional cermets cannot be applied due to short duration of life.

We claim:

1. A high toughness cermet which comprises a sintered alloy comprising 75 to 95% by weight of a hard phase of carbide, nitride or carbonitride containing Ti (titanium), at least one of W (tungsten), Mo (molybdenum) and Cr (chromium), and N (nitrogen) and C (carbon), and the balance of a binder phase composed mainly of an iron group metal, and inevitable impurities, wherein the content of Ti in said sintered alloy is 35 to 85% by weight calculated on TiN or TiN and TiC, and the contents of W, Mo and Cr are 10 to 40% by weight in total calculated on WC, $Mo_2C$ and/or $Cr_3C_2$, the relative concentration of said binder phase at the 0.01 mm-inner portion from the surface of said sintered alloy is 5 to 50% of the average binder phase concentration of the inner portion, and the relative concentration of said binder phase at the 0.1 mm-inner portion from the surface of said sintered alloy is 70 to 100% of the average binder phase concentration of the inner portion, and a compression stress of 30 kgf/mm$^2$ or more remains at the surface of said sintered alloy.

2. The cermet according to claim 1, wherein the content of carbon and nitrogen in the above sintered alloy is 0.2 to 0.8 in terms of weight ratio of carbon/-(carbon+nitrogen).

3. A high toughness cermet which comprises a sintered alloy comprising 75 to 95% by weight of a hard phase of carbide, nitride or carbonitride containing Ti, at least one of W, Mo and Cr, N (nitrogen), C (carbon) and at least one of V (vanadium), Nb (niobium), Ta (tantalum), Zr (zirconium) and Hf (hafnium), and the balance of a binder phase composed mainly of an iron group metal, and inevitable impurities, wherein the content of Ti in said sintered alloy is 35 to 85% by weight calculated on TiN or TiN and TiC, the contents of W, Mo and Cr are 10 to 40% by weight in total calculated on WC, $Mo_2C$ and/or $Cr_3C_2$, the contents of V, Nb and Ta are 30% by weight or less in total calculated on VC, NbC and/or TaC, and the contents of Zr and Hf are 5% by weight or less in total calculated on ZrC and/or HfC, the relative concentration of said binder phase at the 0.01 mm-inner portion from the surface of said sintered alloy is 5 to 50% of the average binder phase concentration of the inner portion, and the relative concentration of said binder phase at 0.1 mm-inner portion from the surface of said sintered alloy is 70 to 100% of the average binder phase concentration of the inner portion, and a compression stress of 30 kgf/mm$^2$ or more remains at the surface of said sintered alloy.

4. The cermet according to claim 3, wherein the content of carbon and nitrogen in the above sintered alloy is 0.2 to 0.8 in terms of weight ratio of carbon/-(carbon+nitrogen).

5. A process for preparing the high toughness cermet according to claim 1 comprising the steps of mixing, molding, sintering and cooling of a starting material comprising carbide, nitride or carbonitride of Ti, and carbide of the 6b group metal (W, Mo and Cr) of the periodic table, or a solid solution of these, wherein said sintering step is carried out under nitrogen gas atmosphere with a constant pressure of 5 to 30 Torr until completion of maintenance at from a liquid phase emergence temperature to a final sintering temperture, and said cooling step after completion of said maintenance at the final sintering temperature and until completion of solidifying the liquid phase is carried out under vacuum at a cooling rate of 10° to 20° C./min.

6. A process for preparing the high toughness cermet according to claim 3 comprising the steps of mixing, molding, sintering and cooling of a starting material comprising carbide, nitride or carbonitride of Ti, carbide of the 6b group metal (W, Mo and Cr) of the periodic table, carbide of the 4b group metal (Ti, Zr and Hf) (excluding Ti) of the periodic table and/or carbide, nitride or carbonitride of the 5b group metal (Ta, Nb and V) of the periodic table, or a solid solution of these, wherein said sintering step is carried out under nitrogen gas atmosphere with a constant pressure of 5 to 30 Torr until completion of maintenance at from a liquid phase emergence temperature to a final sintering temperture, and said cooling step after completion of said maintenance at the final sintering temperature and until completion of solidifying the liquid phase is carried out under vacuum at a cooling rate of 10° to 20° C./min.

* * * * *